US008596379B2

(12) United States Patent
Leonard et al.

(10) Patent No.: US 8,596,379 B2
(45) **Date of Patent: *Dec. 3, 2013**

(54) SYSTEM AND METHOD FOR ASSESSING HYDROGEN SULFIDE IN A HYDROCARBON EXTRACTION WELL IN SITU IN AN ONGOING MANNER

(75) Inventors: Benjamin Leonard, Harris, TX (US); Gerard Simon, Harris, TX (US); Gregory Russ Goddard, Eugene, OR (US)

(73) Assignees: Chevron U.S.A. Inc., San Ramon, CA (US); Los Alamos National Security, Los Alamos, NM (US)

( * ) Notice: Subject to any disclaimer, the term of this patent is extended or adjusted under 35 U.S.C. 154(b) by 408 days.

This patent is subject to a terminal disclaimer.

(21) Appl. No.: 12/957,996

(22) Filed: Dec. 1, 2010

(65) Prior Publication Data

US 2012/0138363 A1 Jun. 7, 2012

(51) Int. Cl.
*E21B 47/00* (2012.01)

(52) U.S. Cl.
USPC ..... 175/40; 166/66; 166/250.01

(58) Field of Classification Search
USPC ..... 166/66, 250.01; 175/40; 324/324, 325
See application file for complete search history.

(56) References Cited

U.S. PATENT DOCUMENTS

| | | | | |
|---|---|---|---|---|
| 3,490,480 | A * | 1/1970 | Parsons | 137/93 |
| 4,468,611 | A * | 8/1984 | Tward | 324/673 |
| 4,473,114 | A * | 9/1984 | Bell et al. | 166/248 |
| 6,740,216 | B2 * | 5/2004 | Diakonov et al. | 204/418 |
| 6,939,717 | B2 * | 9/2005 | Jiang et al. | 436/121 |

* cited by examiner

*Primary Examiner* — Nicole Coy
(74) *Attorney, Agent, or Firm* — Pillsbury Winthrop Shaw Pittman LLP

(57) ABSTRACT

The level of hydrogen sulfide in drilling fluid within a well formed in the Earth is assessed in an ongoing and/or in situ manner. The well may be constructed for the removal of hydrocarbons from the Earth. The assessment of hydrogen sulfide level may be provided in an ongoing manner such that real time, or near real time, fluctuations in hydrogen sulfide levels in the drilling fluid within the well may be conveyed to users. This may provide various advantages over systems in which drilling fluid must be extracted and separately tested for hydrogen sulfide content, and/or in which assessments of hydrogen sulfide level require time for performance.

16 Claims, 3 Drawing Sheets

SYSTEM AND METHOD FOR ASSESSING HYDROGEN SULFIDE IN A HYDROCARBON EXTRACTION WELL IN SITU IN AN ONGOING MANNER

FIELD OF THE INVENTION

The invention relates to the ongoing, in situ monitoring of hydrogen sulfide levels in a well for the extraction of hydrocarbons.

BACKGROUND OF THE INVENTION

In a well used for hydrocarbon extraction, substances may be present that inhibit operation of the well. These substances may be bound up in strata being excavated to form the well and/or the substances may migrate from adjacent strata. One example of such a substance is hydrogen sulfide. Conventional mechanisms for determining a level of hydrogen sulfide in drilling fluid within a well require extraction of drilling fluid for measurement, require a relatively length measurement process, are labor intensive, and/or suffer from other drawbacks.

SUMMARY

One aspect of this disclosure relates to a measurement system configured to measure hydrogen sulfide concentration within drilling fluid in situ in a drilling system configured to drill a wellbore in the Earth. In one embodiment, the measurement system comprises electrical conductors, a signal generator, and one or more processors. The electrical conductors are in direct contact with drilling fluid within the drilling system. The signal generator is configured to apply an electric potential between the electrical conductors such that an electric current runs between the electrical conductors through the drilling fluid. The one or more processors are configured to execute one or more computer program modules including a fluid property module and a hydrogen sulfide concentration module. The fluid property module is configured to determine values of a dielectric property of the drilling fluid based on parameters of the electric current between the electrical conductors. The hydrogen sulfide concentration module is configured to assess the concentration of hydrogen sulfide within the drilling fluid by correlating the determined values of the dielectric property with standards that relate values of the dielectric property with levels of hydrogen sulfide concentration.

Another aspect of this disclosure relates to a method of measuring hydrogen sulfide concentration within drilling fluid in situ in a drilling system configured to drill a wellbore in the Earth. In one embodiment, the method comprises applying an electric potential between electrical conductors disposed in direct contact with the drilling fluid in the drilling system and/or or well bore such that an electric current runs between the electrical conductors through the drilling fluid; and determining the concentration of hydrogen sulfide within the drilling fluid based on the electric current between the electrical conductors.

Yet another aspect of this disclosure relates to a method of calibrating a measurement system configured to measure hydrogen sulfide concentration within drilling fluid in situ in a drilling system configured to drill a wellbore in the Earth. In one embodiment, the method comprises placing electrical conductors included in the measurement system in direct contact with drilling fluid; applying an electric potential between the electrical conductors such that an electric current runs between the electrical conductors through the drilling fluid; taking a first calibration measurement related to an electrical property of the drilling fluid, the first calibration measurement being based on the electric current between the electrical conductors; subsequent to the taking of the first calibration measurement, altering the concentration of hydrogen sulfide present in the drilling fluid; subsequent to alteration of the concentration of hydrogen sulfide present in the drilling fluid, taking a second calibration measurement related to the electrical property of the drilling fluid; and calibrating assessment of the concentration of hydrogen sulfide in the drilling fluid based on the electrical property, wherein the calibration is performed from the first calibration measurement and the second calibration measurement.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
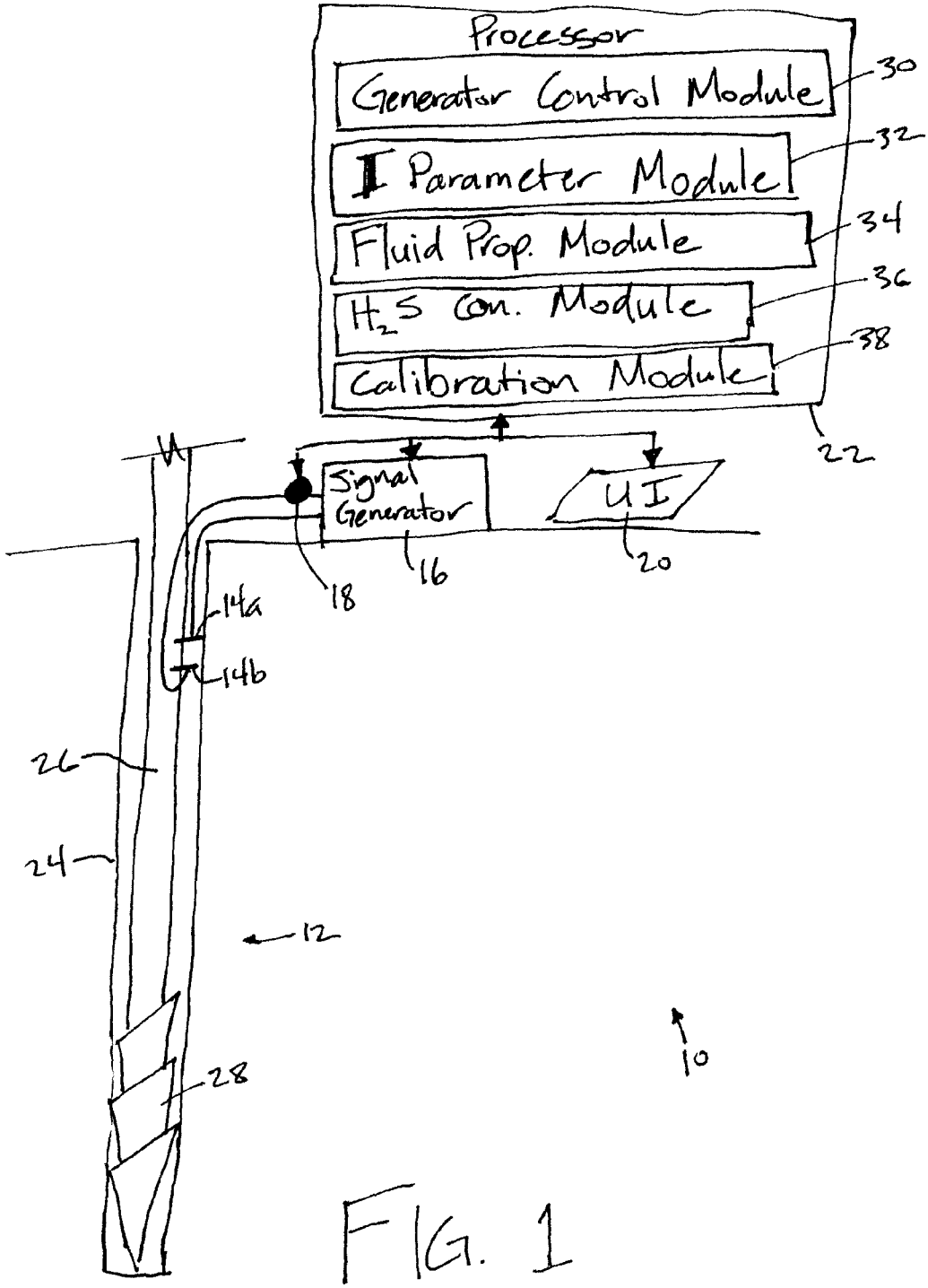
FIG. 1 illustrates a system configured to assess the level of hydrogen sulfide in drilling fluid within a well, in accordance with one or more embodiments of the invention.

FIG. 1 illustrates a system 10 configured to assess the level of hydrogen sulfide in drilling fluid, including water-based drilling fluid, within a well 12 formed in the Earth. The well 12 may be constructed for the removal of hydrocarbons from the Earth. The system 10 is configured to provide the assessment of hydrogen sulfide in an ongoing manner such that real time, or near real time, fluctuations in hydrogen sulfide levels in the drilling fluid within well 12 may be conveyed. System 10 is further configured to assess hydrogen sulfide levels of drilling fluid in situ, and for drilling fluid that is water-based. This may provide various advantages over systems in which drilling fluid must be extracted and separately tested for hydrogen sulfide content, and/or in which assessments of hydrogen sulfide level require time for performance. The system 10 includes one or more of electrical conductors 14 (illustrated as a first conductor 14*a* and a second conductor 14*b*), a signal generator 16, a sensor 18, a user interface 20, a processor 22, and/or other components.

It will be appreciated that the use of the term "ongoing" herein does not preclude determination of periodic samples that indicate the hydrogen sulfide level of the drilling fluid. Instead, the term "ongoing" may mean that the sampling rate of such determinations is great enough that ongoing assessment subsystem 16 provides an indication of the hydrogen sulfide level in a continuous (or substantially continuous) manner.

The well 12 is constructed within a casing 24, with a conduit 26 extending down into well 12 within casing 24. The conduit 26 extends down into well 12 within casing 24, and is part of or and/or carried by a drill pipe that extends toward the surface from a drill bit 28 engaged in deepening (or widening a previously drilled section of) well 12. The conduit 26 is configured to carry drilling fluid from a pump (not shown) into well 12 under pressure. Fluid dispensed from conduit 26 into well 12 stabilizes well 12, removes cuttings, lubricates and/or cleans drill bit 28, and/or serves other purposes within well 12. As drilling continues, substances in the strata around well 12 may migrate into the drilling fluid. Such substances may include substances in strata excavated by drill bit 28, gas and/or liquids that migrate into well 12 through casing 24, and/or other substances. Some of these substances, such as hydrogen sulfide, may be undesirable.

The electrical conductors 14 are configured to be disposed in the drilling fluid within well 12. During assessment of the hydrogen sulfide level within the drilling fluid, a current runs through the drilling fluid between electrical conductors 14 (as is discussed herein). In one embodiment, electrical conductors 14 are arranged in a coaxial configuration with first conductor 14*a* forming the inner conductor and second conductor 14*b* forming the outer conductor encasing the inner conductor. This is not intended to be limiting, as the conductors 14 may be disposed in any arrangement suitable for establishing an electrical current with in the drilling fluid.

The signal generator 16 is configured to apply an electric potential between electrical conductors 14. The electric potential is applied to electrical conductors 14 such that an electric current runs between electrical conductors 14 through the drilling fluid. To apply the electric potential to electrical conductors 14, signal generator 16 is in operative communication with electrical conductors 14 (e.g., via electric leads). The signal generator 16 may be disposed within well 12, or outside of well 12 (e.g., at or near the surface).

The sensor 18 is configured to detect one or more parameters of the electric current through the drilling fluid between electrical conductors 14. The one or more parameters may include one or more of current (rate of flow of electric charge), current phase, current periodicity, and/or other parameters. In one embodiment, sensor 18 is in operative communication with the electric circuit formed between electrical conductors 14 and signal generator 16. By monitoring electric current in this circuit between, for example, one of electrical conductors 14 and signal generator 16, sensor 18 can detect one or more parameters of the electric current within the drilling fluid between electrical conductors 14. Although sensor 18 is illustrated in FIG. 1 as an individual entity, it will be appreciated that this is not intended to be limiting. In one embodiment, sensor 18 includes a plurality of individual sensors that monitor one or more parameters of the electric current through the drilling fluid between electrical conductors 14.

User interface 20 is configured to provide an interface between system 10 and users through which users provide information to and receive information from system 10. This enables data, results, and/or instructions and any other communicable items, collectively referred to as "information," to be communicated between the users and system 10. Examples of interface devices suitable for inclusion in user interface 20 include a keypad, buttons, switches, a keyboard, knobs, levers, a display screen, a touch screen, speakers, a microphone, an indicator light, an audible alarm, and a printer.

It is to be understood that other communication techniques, either hard-wired or wireless, are also contemplated by the present invention as user interface 20. For example, the present invention contemplates that user interface 20 may be integrated with a removable storage interface configured to receive removable electronic storage media. In this example, information may be loaded into, and/or uploaded to, system 10 from removable storage (e.g., a smart card, a flash drive, a removable disk, etc.) that enables the user(s) to customize the implementation of system 10. Other exemplary input devices and techniques adapted for use with system 10 as user interface 20 include, but are not limited to, an RS-232 port, RF link, an IR link, modem (telephone, cable or other). In short, any technique for communicating information with system 10 is contemplated by the present invention as user interface 20.

Processor 22 is configured to provide information processing capabilities in ongoing assessment subsystem 16. As such, processor 22 may include one or more of a digital processor, an analog processor, a digital circuit designed to process information, an analog circuit designed to process information, a state machine, and/or other mechanisms for electronically processing information. Although processor 22 is shown in FIG. 1 as a single entity, this is for illustrative purposes only. In some implementations, processor 22 may include a plurality of processing units. These processing units may be physically located within the same device, or processor 22 may represent processing functionality of a plurality of devices operating in coordination.

As is shown in FIG. 1, processor 22 may be configured to execute one or more computer program modules. The one or more computer program modules may include one or more of a generator control module 30, a current parameter module 32, a fluid property module 34, a hydrogen sulfide concentration module 36, a calibration module 38, and/or other modules. Processor 22 may be configured to execute modules 30, 32, 34, 36, and/or 38 by software; hardware; firmware; some combination of software, hardware, and/or firmware; and/or other mechanisms for configuring processing capabilities on processor 22.

It should be appreciated that although modules 30, 32, 34, 36, and 38 are illustrated in FIG. 1 as being co-located within a single processing unit, in implementations in which processor 22 includes multiple processing units, one or more of modules 30, 32, 34, 36, and/or 38 may be located remotely from the other modules. The description of the functionality provided by the different modules 30, 32, 34, 36, and/or 38 described below is for illustrative purposes, and is not intended to be limiting, as any of modules 30, 32, 34, 36, and/or 38 may provide more or less functionality than is described. For example, one or more of modules 30, 32, 34, 36, and/or 38 may be eliminated, and some or all of its functionality may be provided by other ones of modules 30, 32, 34, 36, and/or 38. As another example, processor 22 may be configured to execute one or more additional modules that may perform some or all of the functionality attributed below to one of modules 30, 32, 34, 36, and/or 38.

The generator control module 30 is configured to control signal generator 16 in the application of the electric potential between electrical conductors 14. This may include controlling one or more of the frequency, the phase, the wave shape, amplitude, the polarity, and/or other parameters of the electric potential.

The presence and amount of hydrogen sulfide present in the drilling fluid causes one or more electrically significant phenomena that will impact various aspects of the electrical circuit formed by signal generator 16, electrical conductors 14, and the drilling fluid. For example, the electrically significant phenomena may include one or more of chemical reaction of hydrogen sulfide with lime, dissolving hydrogen sulfide, gas bubbles within the drilling fluid caused by hydrogen sulfide, and/or other phenomena within the drilling fluid caused by the presence of hydrogen sulfide that impact the electric current between electrical conductors 14.

The generator control module 30 is configured to control signal generator 16 such that one or more parameters of the electric potential applied to electrical conductors 14 is set at a level at which the impact of one or more of the electrically significant phenomena will be enhanced. For example, one or more of the electrically significant phenomena may have specific frequency ranges within which their impact on the electric current is more appreciable. These frequency ranges may be resonant frequency ranges determinable by dielectric spectroscopy. As a non-limiting example, the frequency of the potential may be set by generator control module 30 at between about 50 MHz and about 80 MHz, and/or other frequencies. As a non-limiting example, the amplitude of the potential may be about 100 mV, and/or other amplitudes.

The current parameter module 32 is configured to determine one or more parameters of the current induced within the drilling fluid between electrical conductors 14. This determination may be based on signals received from sensor 18. The one or more parameters may include one or more of frequency, phase, wave shape, amplitude, and/or other parameters of the current induced between electrical conductors 14.

The fluid property module 34 is configured to monitor one or more electrical properties of the drilling fluid. This may include determining values of the one or more electrical properties of the drilling fluid based on one or more parameters of the potential applied to electrical conductors 14 and/or one or more parameters of the electric current induced within the drilling fluid between electrical conductors 14. The one or more electrical properties of the drilling fluid may include, for example, reflectance, resistance, susceptibility, impedance, permittivity, admittance, real and imaginary terms, S-parameters, and/or other properties. By way of non-limiting example, based on a phase difference between the potential and the current, the value of reflectance of the drilling fluid may be determined.

The hydrogen sulfide concentration module 36 may be configured to assess the level of hydrogen sulfide in the drilling fluid based on the property or properties monitored by fluid property module 34, the parameters monitored by current parameter module 32, and/or other variables. By correlating the determined values of the dielectric property with standards that relate values of the dielectric property with levels of hydrogen sulfide concentration hydrogen sulfide concentration module 36 assess the level of hydrogen sulfide in the drilling fluid. Assessing the level of hydrogen sulfide may include determining or estimating the level of hydrogen sulfide, determining whether a threshold level of hydrogen sulfide has been reached, identifying changes in the level of hydrogen sulfide, and/or otherwise assessing the level of hydrogen sulfide. The assessment of the level of hydrogen sulfide may be made by hydrogen sulfide concentration module 36 at or near the sampling rate at which the values of the one or more electrical properties are determined. The hydrogen sulfide concentration module 36 may be configured to present assessments of the level of hydrogen sulfide to users via, for example, user interface 20.

Assessment of the level of hydrogen sulfide in the drilling fluid based on the property or properties monitored by fluid property module 34 may be based solely on the property(ies), or may be based on other parameters impacting electrical properties of the drilling fluid. For example, assessment of the level of hydrogen sulfide in the drilling fluid may be adjusted for current temperature, current pressure, and/or other the current state of other parameters in the drilling fluid at or near electrical conductors 14. The current state of temperature, pressure, and/or other parameters in the drilling fluid may be determined based on output of other sensors (not shown) within well 12.

In one embodiment, hydrogen sulfide concentration module 36 is configured to make a determination of the level of hydrogen sulfide as a function of the values of one or more of the electrical properties determined by fluid property module 34. The hydrogen sulfide concentration module 36 may present the determined level of hydrogen sulfide to users via user interface 20. Presentation of the determined level may include providing a numeric indication of the determination, a descriptive presentation (e.g., low, moderate, high, etc.), illumination of one or more indicator lights (e.g., green for low, yellow for moderate, red for high, etc.), and/or other mechanisms for presenting the determined level of hydrogen sulfide.

In one embodiment, hydrogen sulfide concentration module 36 is configured to compare a metric related to the level of hydrogen sulfide with a threshold. The metric may include the values of an electric property determined by fluid property module 34, an estimate of the level of hydrogen sulfide derived from the values of the electrical property(ies) determined by fluid property module 34, and/or other metrics related to the level of hydrogen sulfide. Responsive to the metric breaching the threshold, hydrogen sulfide concentration module 36 may be configured to take one or more of a variety of actions. For example, hydrogen sulfide concentration module 36 may activate an alarm signal to the users via user interface 20, hydrogen sulfide concentration module 36 may indicate a different level of hydrogen sulfide to the users via user interface 20, hydrogen sulfide concentration module 36 may automatically shut down operations at well 12 (e.g., drilling operations, extraction operations, and/or other operations), and/or may take other action.

The calibration module 38 is configured to calibrate the assessment of hydrogen sulfide levels by hydrogen sulfide concentration module 36. Calibration may be based on determinations of one or more electrical properties of the drilling fluid by fluid property module 34 taken at different levels of hydrogen sulfide. Determinations of electrical properties corresponding to different levels of hydrogen sulfide are obtained by making a first determination while hydrogen sulfide is at a first level, purposely altering the level of hydrogen sulfide in the drilling fluid, and then making a second determination of the one or more electrical properties. Additional alterations of the level of hydrogen sulfide and corresponding determinations of the electrical properties may be made. The level of hydrogen sulfide in the drilling fluid may be purposely altered by, for example, introducing a known quantity of hydrogen sulfide into the drilling fluid at or near electrical conductors 14. Each level of hydrogen sulfide and corresponding determination of one or more electrical properties provides a separate data point that can be used to calibrate the assessment of the level of hydrogen sulfide based on the one or more electrical properties of the drilling fluid.

Calibration of the assessment of the level of hydrogen sulfide by calibration module 38 may include adjusting a function that determines a level of hydrogen sulfide (or a corresponding metric) as a function of a parameter or property monitored by current parameter module 32 and/or fluid property module 34, adjusting a threshold used by hydrogen sulfide concentration module 36 in assessing the level of hydrogen sulfide (e.g., an alarm threshold), adjusting a sensitivity to changes in one or more parameters or properties, adjusting a calibration curve, and/or making other adjustments. Calibration by calibration module 38 may be performed at predetermined intervals, with a predetermined frequency, based on user commands or inputs, based on performance of a measurement by intermittent assessment subsystem 14, and/or at other times.

Figure 2:
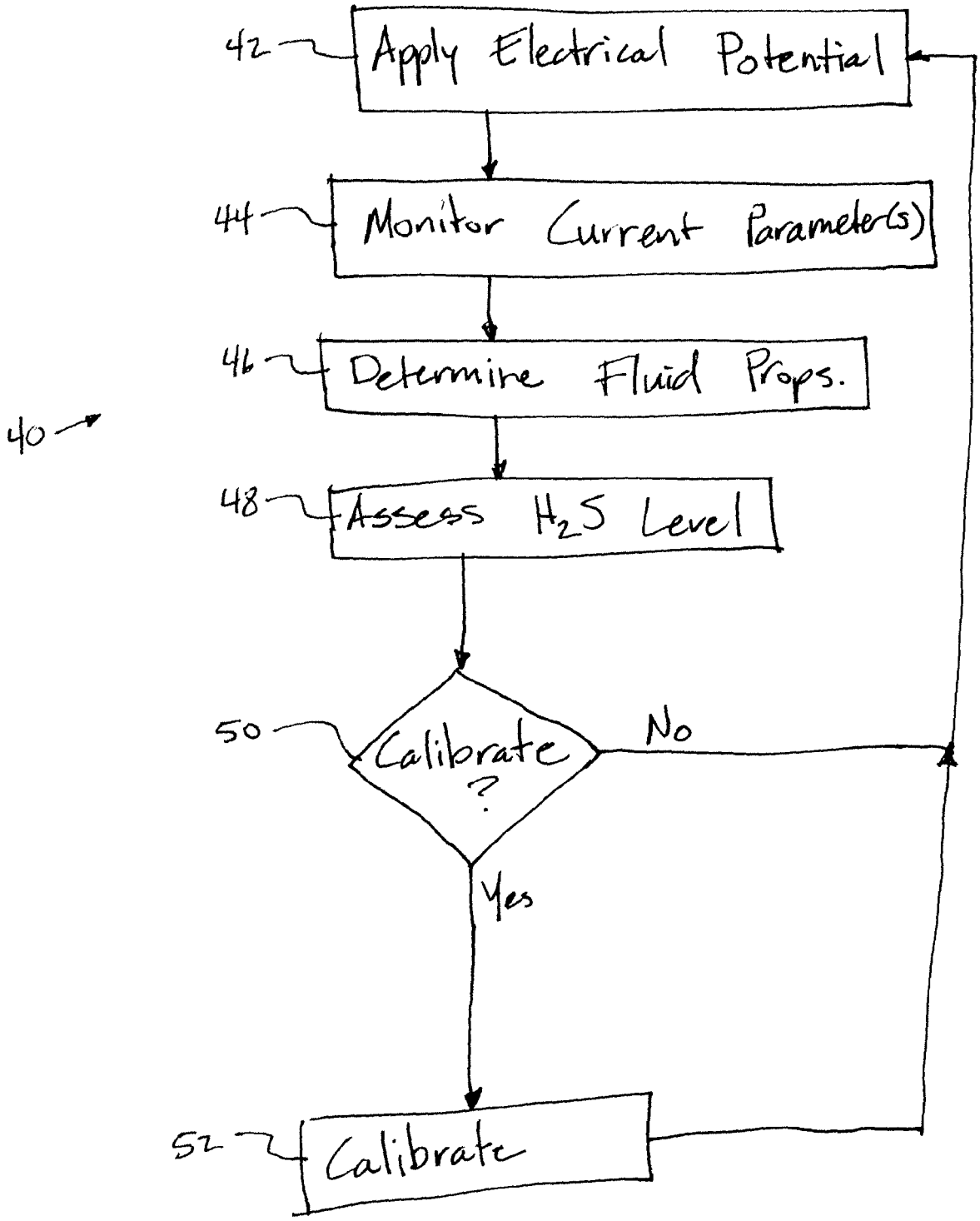
FIG. 2 illustrates a method of assessing the level of hydrogen sulfide in drilling fluid within a well, according to one or more embodiments of the invention.

FIG. 2 illustrates a method 40 of assessing the level of hydrogen sulfide in a well for removing hydrocarbons from the Earth in situ and/or in an ongoing manner. The operations of method 40 presented below are intended to be illustrative. In some embodiments, method 40 may be accomplished with one or more additional operations not described, and/or without one or more of the operations discussed. Additionally, the order in which the operations of method 40 are illustrated in FIG. 2 and described below is not intended to be limiting.

In some embodiments, method 40 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 40 in response to instructions stored electronically on an electronic storage medium. The one or more processing devices may include one or more devices configured through hardware, firmware, and/or software to be specifically designed for execution of one or more of the operations of method 40.

At an operation 42, an electric potential is applied between electrical conductors disposed in direct contact with drilling fluid in the well such that an electric current runs between the electrical conductors through the drilling fluid. In one embodiment, operation 42 is performed by a signal generator similar to or the same as signal generator 16 (shown in FIG. 1 and described above) under control of a generator control module similar to or the same as generator control module 30 (shown in FIG. 1 and described above).

At an operation 44, one or more parameters of the electric current induced within the drilling fluid are monitored. In one embodiment, operation 44 is performed by a sensor and/or current parameter module similar to or the same as sensor 18 and/or current parameter module 32, respectively (shown in FIG. 1 and described above).

At an operation 46, one or more electrical properties of the drilling fluid are determined. The determination is based on the one or more parameters of the electric current monitored at operation 44, one or more parameters of the potential applied at operation 42, and/or other parameters. The one or more properties may include one or more of reflectance, resistance, impedance, permittivity, admittance, real and imaginary terms, S-parameters, and/or other properties. In one embodiment, operation 46 is performed by a fluid property module similar to or the same as fluid property module 34 (shown in FIG. 1 and described above).

At an operation 48, an assessment of the level of hydrogen sulfide in the drilling fluid is made. Operation 48 may include presenting the assessment of the level of hydrogen sulfide to one or more users. The assessment of the level of hydrogen sulfide may be based on the one or more electrical properties determined at operation 46, one or more of the parameters monitored at operation 44, and/or other properties or parameters. In one embodiment, operation 48 is performed by a hydrogen sulfide concentration module similar to or the same as hydrogen sulfide concentration module 36 (shown in FIG. 1 and described above).

At an operation 50, a determination is made as to whether a calibration should be initiated. Calibration may be initiated periodically, at a predetermined or selected interval, based on user input or command, and/or at other times. If calibration is not initiated, method 40 returns to operation 42. If calibration is initiated, method 40 proceeds to an operation 52 at which calibration of the assessment of the hydrogen sulfide level at operation 48 is calibrated. From operation 52, method 40 returns to operation 42.

Figure 3:
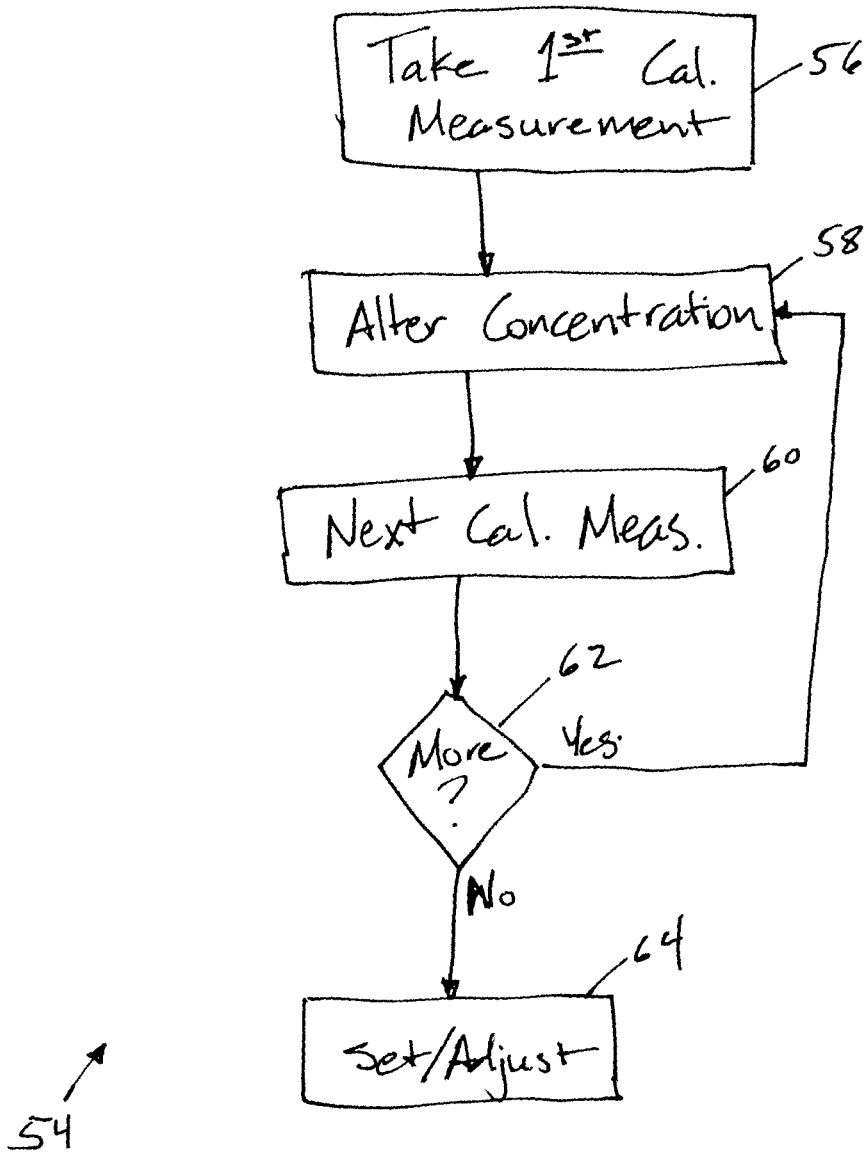
FIG. 3 illustrates a method of calibrating assessment of the level of hydrogen sulfide in drilling fluid based on one or more electrical properties of the drilling fluid, according to one or more embodiments of the invention.

FIG. 3 illustrates a method 54 of calibrating assessment of the level of hydrogen sulfide in a drilling fluid based on electrical properties of the drilling fluid. The operations of method 54 presented below are intended to be illustrative. In some embodiments, method 54 may be accomplished with one or more additional operations not described, and/or without one or more of the operations discussed. Additionally, the order in which the operations of method 54 are illustrated in FIG. 3 and described below is not intended to be limiting. In one embodiment, method 54 is implemented as operation 52 in method 40 (shown in FIG. 2 and described above). However, this is not intended to be limiting as method 54 may be implemented in a variety of alternative contexts.

In some embodiments, method 54 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 54 in response to instructions stored electronically on an electronic storage medium. The one or more processing devices may include one or more devices configured through hardware, firmware, and/or software to be specifically designed for execution of one or more of the operations of method 54.

At an operation 56, a first calibration measurement is taken. The first calibration measurement may be a measurement of one or more electrical properties of the drilling fluid. The first calibration measurement is taken when the concentration of hydrogen sulfide in the drilling fluid is at a first level. The first calibration measurement may be made based on an electric current induced within the drilling fluid. In one embodiment, operation 56 is performed by a fluid property module similar to or the same as fluid property module 34 (shown in FIG. 1 and described above).

At an operation 58, the concentration of hydrogen sulfide in the drilling fluid is purposely altered. This may include adding a known quantity of hydrogen sulfide to the drilling fluid at or near where the measurement of the electrical property(ies) was taken at operation 56. This may include diluting the hydrogen sulfide in the drilling fluid at or near where the measurement of the electrical property(ies) was taken at operation 56.

At an operation 60, a second calibration measurement is taken. The second calibration measurement may be a measurement of the one or more electrical properties of the drilling fluid (e.g., the same property(ies) measured at operation 58). The second calibration measurement is taken subsequent to operation 58, while the concentration of hydrogen sulfide in the drilling fluid is at a second level. In one embodiment, operation 60 is performed by a fluid property module similar to or the same as fluid property module 34 (shown in FIG. 1 and described above).

At an operation 62, a determination is made as to whether additional calibration measurements should be taken. Responsive to a determination that more calibration measurements are needed, method 54 returns to operation 58. Responsive to a determination that no further calibration measurements are needed, method 54 proceeds to an operation 64.

At operation 64, assessment of the level of hydrogen sulfide in the drilling fluid based on the one or more electrical properties is calibrated. The calibration adjusts and/or sets the relationship between the one or more electrical properties and the level of hydrogen sulfide that will be used in future assessments of the level of hydrogen sulfide. For example, the calibration may result in setting or adjusting a threshold, setting or adjusting a function that determines the level of hydrogen sulfide as a function of the electrical properties, setting or adjusting a calibration curve, setting or adjusting sensitivity to changes in one or more electrical properties, and/or other adjustments. In one embodiment, operation 64 is performed by a calibration module similar to or the same as calibration module 38.

While the above-described embodiments are generally directed to the ongoing, in situ monitoring of hydrogen sulfide gas in drilling fluid, it is also contemplated that other species of interest could similarly be monitored in the drill fluid—provided that the measured dielectric property values for another such system could be correlated with values and/or concentrations determined intermittently and/or calibratively, as described herein for drilling fluids comprising hydrogen sulfide. Examples of species of potential interest include, but are not limited to, CO, propane, butane, and the like.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A measurement system configured to measure hydrogen sulfide concentration within drilling fluid in situ in a drilling system configured to drill a wellbore in the Earth, the measurement system comprising:

electrical conductors in direct contact with drilling fluid within the drilling system;

a signal generator configured to apply an electric potential between the electrical conductors such that an electric current runs between the electrical conductors through the drilling fluid; and one or more processors configured to execute one or more computer program modules, the one or more computer program modules comprising:

a fluid property module configured to determine values of a dielectric property of the drilling fluid based on parameters of the electric current between the electrical conductors; and a hydrogen sulfide concentration module configured to assess the concentration of hydrogen sulfide within the drilling fluid by correlating the determined values of the dielectric property with standards that relate values of the dielectric property with levels of hydrogen sulfide concentration.

2. The measurement system of claim 1, wherein the dielectric property is reflectance.

3. The measurement system of claim 1, wherein the signal generator is configured such that the electrical potential is an alternating current potential.

4. The measurement system of claim 3, wherein the signal generator is configured such that the frequency of the alternating current potential is between about 50 MHz and about 80 MHz.

5. The measurement system of claim 1, wherein the signal generator is configured such that the amplitude of the potential is about 100 mV.

6. The measurement system of claim 1, wherein the electrical conductors comprise an inner conductor and an outer conductor of a coaxial conductor.

7. A method of measuring hydrogen sulfide concentration within drilling fluid in situ in a drilling system configured to drill a wellbore in the Earth, the method comprising:

applying an electric potential between electrical conductors disposed in direct contact with the drilling fluid in the drilling system and/or or well bore such that an electric current runs between the electrical conductors through the drilling fluid;

determining values of a dielectric property of the drilling fluid based on parameters of the electric current between the electrical conductors; and determining the concentration of hydrogen sulfide within the drilling fluid based on the determined values of the dielectric property of the drilling fluid.

8. The method of claim 7, wherein the dielectric property is reflectance.

9. The method of claim 8, wherein the electrical potential is an alternating current potential.

10. The method of claim 9, wherein the frequency of the alternating current potential is between about 50 MHz and about 80 MHz.

11. The method of claim 7, wherein the amplitude of the potential is about 100 mV.

12. The method of claim 7, wherein the electrical conductors comprise an inner conductor and an outer conductor of a coaxial conductor.

13. A method of calibrating a measurement system configured to measure hydrogen sulfide concentration within drilling fluid in situ in a drilling system configured to drill a wellbore in the Earth, the method comprising:

placing electrical conductors included in the measurement system in direct contact with drilling fluid;

applying an electric potential between the electrical conductors such that an electric current runs between the electrical conductors through the drilling fluid;

taking a first calibration measurement related to an electrical property of the drilling fluid, the first calibration measurement being based on the electric current between the electrical conductors;

subsequent to the taking of the first calibration measurement, altering the concentration of hydrogen sulfide present in the drilling fluid;

subsequent to alteration of the concentration of hydrogen sulfide present in the drilling fluid, taking a second calibration measurement related to the electrical property of the drilling fluid; and calibrating assessment of the concentration of hydrogen sulfide in the drilling fluid based on the electrical property, wherein the calibration is performed from the first calibration measurement and the second calibration measurement.

14. The method of claim 13, further comprising calibrating measurement of the concentration of hydrogen sulfide present in the drilling fluid based on the electric current between the electrical conductors based on the first calibration measurement and the second calibration measurement.

15. The method of claim 14, wherein calibrating measurement of the concentration of hydrogen sulfide comprises determining or adjusting a calibration curve.

16. The method of claim 15, wherein altering concentration of hydrogen sulfide in the drilling fluid comprises adding a known amount of hydrogen sulfide.

* * * * *